US006105468A

United States Patent [19]

Fohrman et al.

[11] Patent Number: 6,105,468

[45] **Date of Patent: *Aug. 22, 2000**

[54] MULTI-PURPOSE OPENER

[75] Inventors: Scott R. Fohrman, Wilmette; Kevin M. Hess, Mount Prospect, both of Ill.

[73] Assignee: The Pampered Chef, Ltd., Addison, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/024,052

[22] Filed: Feb. 17, 1998

[51] Int. Cl.[7] ..... B67B 7/44

[52] U.S. Cl. ..... 81/3.09; 81/3.4; 81/3.55

[58] Field of Search ..... 81/3.09, 3.4, 3.55, 81/3.57, 3.27

[56] References Cited

U.S. PATENT DOCUMENTS

| | | | |
|---|---|---|---|
| D. 238,411 | 1/1976 | Levenson | D7/6 |
| D. 297,203 | 8/1988 | Chouinard | D8/33 |
| D. 311,668 | 10/1990 | Bryant et al. | D8/40 |
| 1,170,160 | 2/1916 | Keller et al. | 81/3.57 X |
| 2,330,893 | 10/1943 | Hutaff, Jr. | 81/3.55 |
| 2,542,329 | 2/1951 | Hammond, Jr. | 81/3.57 |
| 3,877,327 | 4/1975 | Erm | 81/124.4 |
| 4,455,894 | 6/1984 | Roberts | 81/3.09 |
| 4,474,087 | 10/1984 | Widman | 81/3.09 |
| 4,607,407 | 8/1986 | Bergmeister | 81/3.09 X |
| 4,723,465 | 2/1988 | Hughes | 81/3.09 |
| 4,846,024 | 7/1989 | Bryant et al. | 81/3.09 |
| 4,967,622 | 11/1990 | Phillips | 81/3.09 |
| 4,979,407 | 12/1990 | Hernandez et al. | 81/3.09 |
| 5,313,859 | 5/1994 | Garby et al. | 81/3.09 X |
| 5,388,297 | 2/1995 | Ross | 81/3.09 X |
| 5,806,380 | 9/1998 | Wilse | 81/3.09 |

FOREIGN PATENT DOCUMENTS

| | | |
|---|---|---|
| 2531453 | 2/1977 | Germany . |
| 33060741 | 8/1984 | Germany . |
| 2014073 | 8/1979 | United Kingdom . |

*Primary Examiner*—D. S. Meislin
*Attorney, Agent, or Firm*—Olson & Hierl, Ltd.

[57] ABSTRACT

A multi-purpose closure opener for use with a variety of containers including twist-top bottles, vacuum-sealed jars and tab-top cans. A rigid elongated main body supports a twist-top opening section, a jar lid opening section and a tab-top can closure opening section for convenient opening of a selected one of these several containers in a single unitary construction. The twist-top opening section allows engagement of at least two bottle cap types, while the tab-top can closure opening section is designed to engage a variety of different sized and shaped tabs. The jar lid opening section permits easy jar lid seal-breaking convenience on the same opener. A magnet secured to the elongated body allows the opener to be mounted for storage on a kitchen appliance, such as a refrigerator, having a metal surface, or other suitable metal surface.

14 Claims, 1 Drawing Sheet

MULTI-PURPOSE OPENER

FIELD OF THE INVENTION

This invention relates to multi-purpose closure openers for containers, and more particularly, to multi-purpose closure openers for use with conventional bottles, jars, cans, and the like containers.

BACKGROUND OF THE INVENTION

Twist-top bottle cap openers, lid openers for jars, vacuum-sealed jars, and tab-top can openers, have been known for some time. These separate implements are found in the kitchens of many homes and are used on an almost daily basis. No kitchen would be considered complete without these types of openers. However, these separate openers take up considerable space and cause clutter in the drawer or on the shelf where they are each normally stored. In one aspect of the present invention, the separate implements are combined in a unique functional arrangement to provide a unitary multi-purpose closure opener for a variety of different uses.

Several patents currently exist which pertain to multi-purpose openers. U.S. Pat. No. 4,455,894 to Roberts discloses a hand held opening tool having a single twist-top bottle opener, a tab-top opener, and a bag slitting feature.

Similarly, U.S. Pat. No. 5,388,297 to Ross discloses a tool having at one end at least two different sets of teeth for engaging twist-top caps. This device is particularly suited for medicine bottles, as it has a blade at the opposing end for puncturing safety seals.

Still another opener tool is shown in German Patent Document No. DT 2531453. This patent discloses a twist-top opener with two serrated edges tapered inwardly for gripping various bottle top sizes. The disclosed tool device is capable of engaging a bottle cap at only two points on the cap. It also shows a rather cumbersome vacuum-jar opener, and a tab-top opener.

However, these and other known closure openers have various disadvantages, such as a lack of unitary construction; failure to combine the most commonly used opening devices into a single, easy-to-use structure; failure to use an effective jar lid opening configuration; and failure to fix twist-top grips to prevent slippage when engaging different sized bottle caps.

Disadvantages and deficiencies in the known prior art have been addressed by the present invention.

SUMMARY OF THE INVENTION

This invention relates to a multi-purpose closure opener for use with a variety of containers, for example, twist-top bottles, jars with lid closures, tab-top cans, and the like, which includes in a presently preferred embodiment, a substantially flat elongated body of molded plastic with several distinct functional sections incorporated therein. The functional sections are preferably integrally molded with the body to form an aesthetically pleasing and practical unitary construction. In this manner, the present invention has no detachable or movable component parts to become lost or broken during manufacture or during household use. The preferred construction of the present invention, therefore, affords advantages of reliability, durability, and ease of cleaning, use and manufacture.

The present opener is designed with a tab-top opener section having a tab lifter for opening push-tab soda cans, and the like, including pull-tab closure tops as well. The tab lifter is preferably integrated into the substantially flat, elongated body and comprises a slot extending a sufficient distance into the body to receive a can tab. The slot is defined within the body by upper and lower surfaces in the body, and opposing side surfaces in the body. While the present embodiment of the multi-purpose closure opener employs the tab-top opener section at one end of the elongated body, it is anticipated that alternative embodiments may be designed with at least one slot extending into a side of the elongated body of the multi-purpose closure opener.

The present multi-purpose closure opener is also designed with a jar lid opener section, which is useful for breaking the seal of vacuum sealed jars, to permit easier opening and removal of the lid from the jar. The jar lid opener section includes a lid engaging structure attached to the second end of the substantially flat elongated body. The lid engaging structure comprises an outward extension from the elongated body, and a transverse extension from the elongated body. Both extensions are preferably unitary with the elongated body.

The transverse extension has an angled lip or catch attached proximate to the end of the extension furthest from the substantially flat elongated body. The outward extension has at least one lid contact projection affixed to the lower surface of the extension to help stabilize the multi-purpose closure opener on the jar lid.

The bottle opening section of the multi-purpose closure opener for opening twist-top bottles and the like is comprised of a cylindrical member having an entry opening and an inner cylindrical wall having defined thereon two annular areas of a plurality of spaced ribs, with the first area spaced outwardly from the second area. The ribs on the first outer area are more widely spaced for opening containers, such as beer bottles. The second inner area of ribs are more closely spaced for opening containers, such as two-liter bottles.

Other objects and advantages of the present invention will be made apparent to those skilled in the art in the present specification taken with the accompanying drawings and the appended claims.

BRIEF DESCRIPTION OF THE DRAWINGS

There is shown in the attached drawing a presently preferred embodiment of the present invention, wherein like numerals in the various views refer to like elements and wherein.

DETAILED DESCRIPTION

Figure 1:
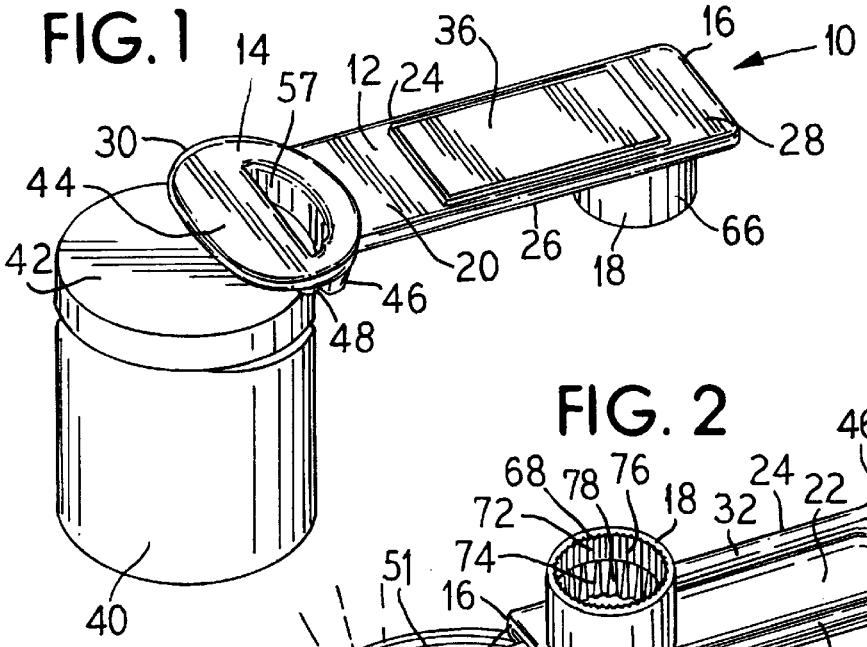
FIG. 1 is a perspective view of the multi-purpose closure opener of the present invention operatively engaged with the lid of a jar.

Referring to the drawings, there is shown a multi-purpose closure opener 10, which is suitable for opening the closures of a variety of containers, such as cans, bottles, jars, and the like.

Multi-purpose closure opener 10 incorporates into a unitary elongated flat body 12, a jar lid opening section 14, a tab-top opening section 16 and a twist-top cap opening section 18. The present embodiment is also comprised of a mounting means for convenient storage of the opener when not in use. Elongated body 12 is preferably substantially planar and flat in design, having upper surface 20, lower surface 22, first edge 24, second edge 26, first end 28 and second end 30 (see FIGS. 1 and 4). Integrally formed longitudinal ribs 32 and 34 (see FIG. 2) extend substantially the length of body 12 adjacent to edges 24 and 26 and help give rigidity to the preferably injection-molded plastic body 12.

Figure 3:
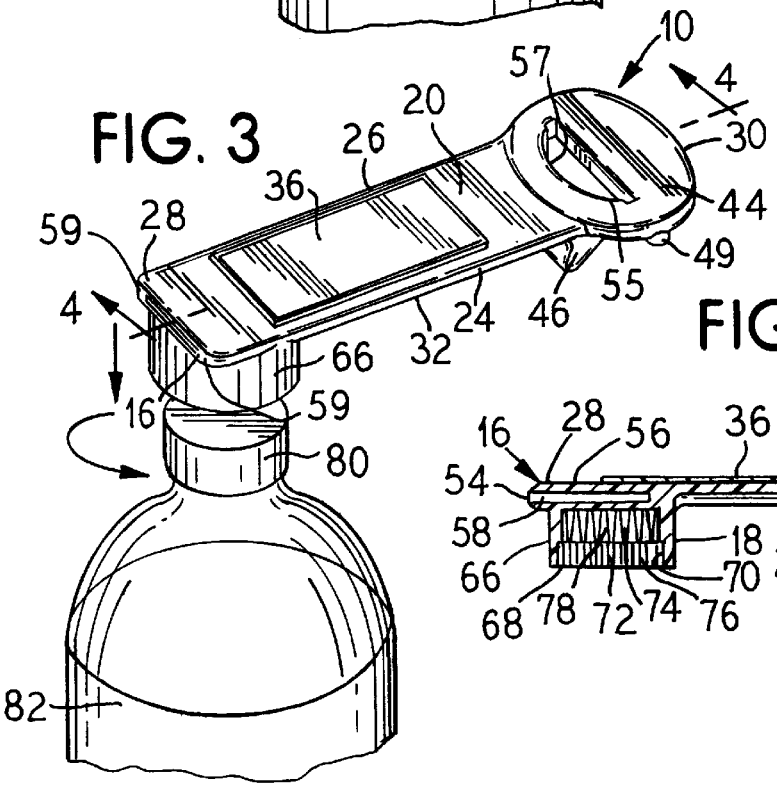
FIG. 3 is a perspective view of the multi-purpose closure opener of FIG. 1 aligned over the cap of a twist-top bottle and positioned for functional engagement with the cap.
Figure 4:
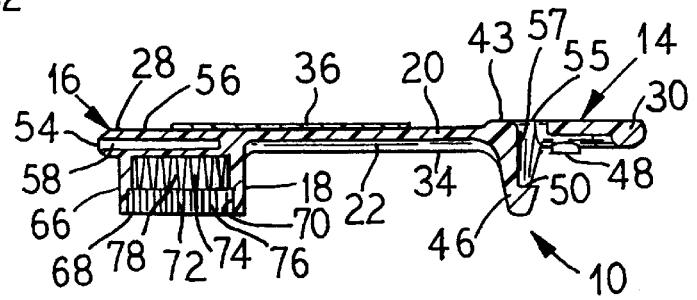
FIG. 4 is a longitudinal vertical sectional view of the multi-purpose closure opener taken along the line 4—4 of FIG. 3.

Magnet 36, which comprises the mounting means for convenient storage of the opener 10, is shown in FIGS. 1, 3 and 4 attached to the upper surface 20 of the elongated body 12. The magnet 36 has a flattened rectangular shape as viewed from above in FIG. 1, and is useful for storing opener 10 on a kitchen appliance having a metal surface, such as a refrigerator, microwave or stove, when not in use. In this way, the multi-purpose closure opener 10 will be visible and readily available to a user when needed in the kitchen.

Alternatively, opener 10 may be equipped with an integral loop (not shown) that is capable of being engaged with a separate hook member (not shown) for storage. Hook-and-loop material may also be employed for this purpose. These alternatives, and any other device that would accomplish the goal of convenient storage of opener 10 during periods of non-use, are considered to fall within the intended spirit and scope of the present invention.

Referring to FIGS. 1, 3 and 4, the jar lid opening feature of opener 10 can be more readily understood. The jar 40 may include, for example, those used in home canning, baby food jars, sauce jars and the like, and is generically represented in the drawing of FIG. 1. Typically the jars 40 are made of glass, although plastic jars are becoming more prevalent, and usually have large openings covered with a lid 42. Ordinarily, the jar has an external thread adjacent the top of the jar, which is cooperatively engaged by an internal thread segment or thread segments on the lid 42.

The jar lid closure opening section 14 is adapted to break the vacuum seal between the jar 40 and lid 42 to enable rotation of the jar lid 42 with respect to the jar 40 to remove the lid 42 from the jar 40.

The jar lid closure opening section 14 includes lid engaging means contacting the lid 42 of the jar 40 at several points. Specifically, as shown in FIG. 1, the lid engaging means comprise an outward extension 44 lying generally in the plane of the elongated body 12 and transverse extension 46. To further aid the attachment of the opener 10 to the lid 42, outward extension 44 has stabilizing means in the form of two lid contact projections 48, 49 (see FIG. 2), and transverse extension 46 has a lip or catch 50 (see FIG. 4) formed thereon for engaging the underside of the annular flange on lid 42. The elongated body 12 acts as a lever to which force may be applied to help break the seal between the lid 42 and the jar 40 and permit ease of rotation between the jar 40 and the lid 42 after the seal has been broken.

Figure 2:
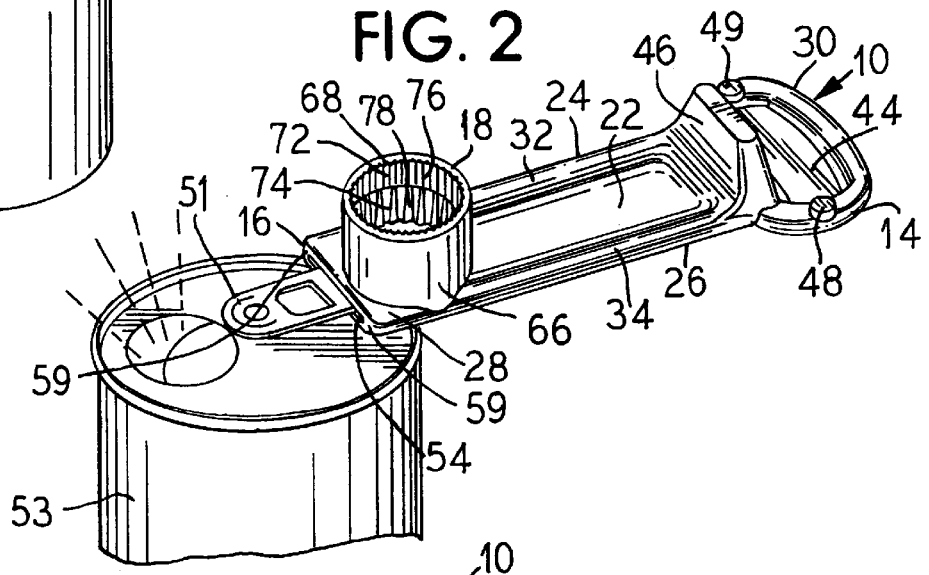
FIG. 2 is a perspective view of the multi-purpose closure opener of FIG. 1 operatively engaged with the opener tab of a push-top can.

FIGS. 1 and 2 show outward extension 44 having a stabilizing contact projection 48 proximate to second edge 26. A second lid contact projection 49 identical to the first, is located proximate to first edge 24 of outward extension 44. FIG. 4 which is a longitudinal cross-section of body 12 better shows a lip or catch 50 formed integral on transverse extension 46 for engaging the lower edge or underside of the annular flange of lid 42.

To break the vacuum-seal on a jar, as shown in FIG. 1, outward extension 44 is positioned over jar lid 42, with the lid contact projections 48, 49 resting on the top surface of the jar lid 42, while transverse extension 46 is brought into contact with the side of the jar lid 42. Transverse extension 46 is positioned to allow lip or catch 50 to engage the underside of the annular flange of the lid 42. Transverse extension 46 is provided with a smooth concave surface 57 extending from the lip or catch 50 to the top or upper surface 20 of body 12 as shown in FIG. 1. The curve of surface 57 allows closer abutment of opener 10 to the jar lid 42, permitting greater engagement of lip or catch 50 with the underside of the annular flange of the lid 42. There is an opening 55 formed in the outward extension by means of which the user can better observe the engagement of the lip 50 with the undersigned of jar lid 42. A sufficient force is then applied to first end 28 of opener 10, in an upward direction, as shown by the arrow of FIG. 1, to break the seal between the lid 42 and the jar, and thus enable the user to more readily rotate the lid 42 relative to the jar 40 for removal of the lid 42 from the jar 40 to permit access to the contents of the jar 40.

Lid contact projections 48, 49 help to lessen the lateral motion of opener 10 as the vacuum-top closure opening section 14 is engaged with the vacuum-sealed jar 40. Lid contact projections 48, 49 also move the points of contact with the surface of the jar lid 42 closer to the transverse extension 46. In this manner, the upward movement necessary for opener 10 to break the vacuum-seal of the jar 40 is reduced. This construction also reduces the likelihood of slippage of opener 10 from the jar 40 when opener 10 is raised, which slippage may result as lip or catch 50 is being pulled away from the annular flange of the underside of the jar lid 42 as first end 28 of opener 10 is raised.

Lid contact projections 48, 49 also retain the end of outward extension 44 above the surface of the lid 42 to create a small gap. The size of the gap is approximately equal to the height of contact projections 48, 49 from the underside of the outward extension 44. The gap prevents the end of outward extension 44 from pressing into the surface of the jar lid 42, thereby creating resistance to the upward movement of opener 10. Though the gap is relatively small, lid engaging means need only pivot an amount sufficient to break the vacuum-seal of the jar. The two projections 48, 49 should, however, be of a length sufficient to facilitate the manual operation of breaking the seal when in use. Because many vacuum-sealed lids are of varying diameters and sizes of annular flange (the portion of the lid having internal thread segments for engaging complementary external threads on the jar) sizes, it is desirable that the multi-purpose opener 10 work well on a variety of lids.

Longitudinal ribs 32, 34, shown best in FIG. 2, also play a role in enhancing the case of opening of vacuum-sealed jars. Ribs 32, 34 provide a rigidity to body 12 of opener 10. This is an important feature as it prevents a large amount of flex in body 12 during use. The minimal flex directs more force to the lip or catch 22 when opener 10 is used to open a vacuum-sealed jar 40. Once the seal has been broken (indicated usually by the "pop" of the lid) the lid 42 can be easily removed from the jar 40 with a counter-clockwise twist by the user.

Referring now to FIG. 2, the tab-top closure opening section 16 can be seen engaged in opening the pop-tab top 51 of a beverage can 53. The tab-top closure opening section 16 can be used for opening a container having either a pop-tab (e.g., the can shown in FIG. 2) or a pull-tab top (not shown).

In the present invention, the tab-top closure opening section 16 comprises a slot 54 located at the first end 28 of opener 10, opposite the jar lid opening section 14. The slot 54 which is integrally formed between upper and lower surfaces 56 and 58 in the elongated body 12 and opposed sides 59 in the elongated body define the tab engaging means. Preferably, slot 54 extends over a substantial portion of the width of body 12. This allows tabs of various shapes and widths to be accommodated within slot 54.

Also of importance to the practice of the present embodiment, as shown in cross-section in FIG. 4, is that slot 54 extends a distance well into body 12 of opener 10. For some applications only a small portion of the can tab 51 will need to be inserted into slot 54. However, in other applications it may be necessary to insert a substantial portion of the tab, which may be an inch or more in length, into slot 54. Therefore, where use of the present invention is intended for opening such lengthy tabs it may be desirable to design opener 10 with an extra deep slot.

A concern in making a deeper slot 54 may be compromising the integrity of multi-purpose closure opener 10. Specifically, the jar lid closure opening section 14, which may be subjected to a great amount of stress in use, may be adversely affected if too great a void is created in the first end 28 by slot 54. The strength of body 12 of opener 10 may be enhanced by the use of a stronger plastic material, or other suitable structural enhancements, such as the longitudinal ribs 32, 34 as discussed above.

In order to provide an opener 10 capable of accommodating an array of tab sizes and shapes, slot 54 should preferably be made substantially wider and deeper than a standard tab-top. For example, a standard pop-top tab has a width of approximately 0.5 inches (1.5 cm), and a length of approximately 1 inch (2.5 cm). Therefore, dimensions of approximately 1 inch (2.5 cm) wide by approximately 1.5 inches (3.8 cm) long for slot 54 in opener 10 would be reasonable. Naturally, however, larger dimensions, as well as smaller dimensions of slot 54 may be used and still fall within the scope and spirit of the present invention.

Likewise, the location of slot 54 is not intended to be limited to that shown in FIG. 2. Slot 54 may be located along first edge 24 or second edge 26 for some applications. This would allow for wider slots, if necessary. Other design modifications might be required with such an embodiment.

To use the tab-top closure opening section 16 shown in FIG. 2, it is best to position opener 10 with lower surface 22 of body 12 facing upwards. In this position, twist-top cap opening section 18 will not interfere with the can opening process.

Slot 54 is then slid into engagement with the tab 51 until the tab 51 is suitably enclosed within slot 54. By lifting upwards on the second end 30 of the body 12 of opener 10 (i.e., the end having jar lid engaging opening section 14), the tab is resultantly pressed into the initially sealed, marked or defined opening on the surface of the can top. A sufficient amount of lifting force on second end 30, will break the sealed opening and permit access to the contents of can 53.

Similarly, in opening a pull-tab top (or ring-top) can, slot 54 is engaged with the ring of the pull-tab top. Second end 30 of body 12 is lifted sufficiently to elevate the ring and to break the can seal. At this point, the ring may be disengaged from slot 54, and the remaining opening steps may be accomplished manually or by any other means without the aid of opener 10.

Referring now to FIGS. 3 and 4, it is observed that the twist-top cap opening section 18 is comprised of a cylindrical member 66 having an opening 68 and an interior wall 70 (FIG. 4).

The interior wall 70 of the cylindrical member defines cap engaging means for a bottle to be opened. The interior wall 70 is divided into two distinct areas: a first cap engaging area 72 and second cap engaging area 74. First cap engaging area 72 is stepped inwardly from second cap engaging area 74, such that the diameter of the interior wall 70 at first cap engaging area 72 is slightly greater than the diameter of the interior wall 70 of second cap engaging area 74.

The two areas 72 and 74 are each comprised of a plurality of spaced ribs, 76 and 78 (see FIG. 2), respectively. Preferably, ribs 76 of first area 72 are more numerous than ribs 78 of second area 74. This requires, of course, that ribs 76 be more closely spaced than ribs 78. Ribs 78 of second area 74, in the present embodiment, are also wider and longer than ribs 76 of first area 72. The axial extent of ribs 76 in the first cap engaging area 70 is less than the axial extent of the ribs 78 in the second cap engagement area 74. The purpose of this distinction has to do with the particular cap which each area is designed to engage. The ribs 76 and 78 are preferably evenly spaced one from the other circumferentially about the interior wall 70.

In the present embodiment, the first cap engagement area 72 is designed to fit about plastic caps that are typically used on two-liter bottles and the like. These caps have numerous small vertical ribs about the exterior of their sidewalls, and are substantially uniform around the periphery with no appreciable outward pitch to the cap wall. These features allow such caps to be securely gripped and twisted from the top portion of their sides (i.e., without engaging the entire cap).

The second cap engagement area 74 is designed to grip metal caps which are typically used on beer bottles and the like. These caps usually have ribs along the bottom edge of their sides for gripping and twisting. Due to this positioning of the ribs, more of the cap has to be inserted into cap engagement area 74 to ensure proper engagement of the cap ribs by the second area ribs 78. Therefore, more lengthy area (i.e., deeper into the cylindrical member) is needed for second area 74.

In use, referring to FIG. 3, for example, cylindrical member 66 is applied to the bottle cap 80 to be removed from bottle 82. Opener 10 will be positioned upon the cap at the area 72 or 74 which best fits the type of cap to be removed. However, some minor manipulation by the user may be required to insure that a proper grip is established.

When opener 10 is properly seated onto the cap 80, force is applied to the second end 30 of opener 10 to rotate the opener 10 counter-clockwise to loosen the cap 80 from the bottle 82 or to break the seal of the cap 72. Once the cap 80 is loosened, the counter-clockwise turning of the opener 10 may cease and the opener 10 may be removed from the cap 80 to allow manual removal of the cap, or the turning may continue until complete removal of the cap 80 from the bottle 82 is achieved.

Where the twist-top bottles are resealable, the present opener 10 may also be used to reseal the bottle by reapplying the cap. For this operation the cap 80 may first be manually applied to the bottle 82. Then in the same manner as discussed above, cylindrical member 66 of opener 10 may be seated at the proper area onto the cap. The cap is then rotated in a clockwise manner by applying appropriate force to second end 30 of body 12 of opener 10. Caution should be taken so as not to over-tighten the cap. This may result in breakage of the cap, stripping of the cap ribs, or other such damage.

Furthermore, the diameter of the opening defined by each cap engagement area 72, 74 within the cylindrical member 66 is preferably different. That is, the diameter of the opening of the first cap engagement area 72 is slightly greater than the diameter of the opening of the second engagement area 74. The slight step inward of the interior wall 70 between the areas 72, 74 prevents bottles intended to be opened by first area 72 from entering second area 74, while still allowing the smaller lids intended to be opened in second area 74 to enter without interference from first area 72, which it must first pass through.

In other embodiments, additional engagement areas may be designed into the cylindrical number 66. It is anticipated that the step-wise configuration would be followed for the best results. Such a design might be achieved by adding one or more smaller diameter areas after the second area 74.

While a presently preferred embodiment of the present invention is shown, it will be apparent to persons of ordinary skill in the art that the invention may be otherwise embodied without departing from the spirit and scope thereof. It is therefore intended by the appended claims to cover all modifications which fall within their true spirit and scope.

What is claimed is:

1. A multi-purpose closure opener for opening the closures of a variety of containers comprising:

a. an elongated body having a first edge, a second edge opposed to said first edge, an upper surface, a lower surface, a first end and a second end;

b. a tab-top opening section integral with said elongated body and having tab engaging means formed in said first end of said body;

c. a twist-top cap opening section having, attached to said lower surface of said body at said first end, a cylindrical member with an opening and an interior wall with cap engaging means thereon, said cap engaging means having a first cap engagement area for engaging with caps of one configuration and a second cap engagement area for engaging caps of a second configuration, said tab engaging means overlying said twist-top cap opening section; and d. a jar lid opening section integral to said body and having lid engaging means proximate to said second end of said body comprising an outward extension of said body and a transverse extension of said body, said outward extension including a first stabilizing projection extending generally downwardly from said first edge of said body and a second stabilizing projection opposed from said first stabilizing projection and extending generally downwardly from said second edge of said body, whereby the tab-top opening section, the twist-top cap opening section and the jar lid opening section are integrally combined on the body and can be used selectively to open a desired container.

2. The multi-purpose opener as described in claim 1 including mounting means attached to said upper surface of said body.

3. The multi-purpose closure opener as described in claim 2 wherein said mounting means comprises a magnet affixed to the upper surface of the body.

4. The multi-purpose closure opener as described in claim 1 wherein said first cap engagement area comprises a first annular region with a plurality of spaced ribs on said interior wall, and wherein said second cap engagement area comprises a second annular region with a plurality of spaced ribs on said interior wall.

5. The multi-purpose closure opener as described in claim 4 wherein said spaced ribs of said first cap engagement area and said spaced ribs of said second cap engagement area are each evenly spaced on the interior wall of the cylindrical member.

6. The multi-purpose closure opener as described in claim 1 wherein said body, tab-top opening section, twist top cap opening section, jar lid opening section are made from plastic and are integrally joined together by molding.

7. The multi-purpose closure opener as described in claim 5 wherein said interior wall has a stepped diameter, and wherein the diameter of said interior wall within said first engagement area is greater than the diameter of said interior wall within said second engagement area.

8. The multi-purpose closure opener as described in claim 7 wherein said first engagement area is proximate to said opening of said cylindrical member, and wherein said second engagement area is spaced from said opening.

9. The multi-purpose closure opener as described in claim 4 wherein the number of said plurality of ribs in said second engagement area is less than the number of said plurality of ribs in said first engagement area.

10. The multi-purpose closure opener as described in claim 1 wherein said tab engaging means comprises a slot formed in said first end of said body.

11. The multi-purpose closure opener as described in claim 1 including body rigidifying means comprising at least one longitudinal rib on the body.

12. A multi-purpose opener for opening the closures of a plurality of containers, such as cans with tab tops, bottles with twist top caps and jars with vacuum sealed lids, comprising:

a. an elongated, relatively flat body having a first edge, a second edge, an upper surface, a lower surface, a first end, a second end and at least one longitudinally extending rib disposed between said first end and said second end;

b. a can tab top opening section, integral to said first end, having a slot extending into said body for receiving the tab of a can to be opened, whereby lifting the second end of the body will cause the tab to open the opening in the can;

c. a twist top opening section, attached to said lower surface of said body and located at said first end generally below said can tab top opening section and said slot having a cylindrical outer wall generally perpendicular to said body and defining an opening at the outer end, and an interior wall having at least two areas, including a first annular cap engagement area, proximate to said opening, having a plurality of spaced, raised ribs, and a second cap engagement area, adjacent to said first area and remote from said opening, having a plurality of spaced, raised ribs, the diameter of the interior wall defining the first cap engagement area being greater than the diameter of the interior wall defining the second cap engagement area; and d. a jar lid opening section having an enlarged, outward extension attached at said second end of said body, having first and second protruding, stabilizing lid contact projections affixed to a lower surface of said outward extension along said first and second edges of said body respectively, and adapted to engage the top of the jar lid in use, and a transverse extension, substantially perpendicular to and attached at said second end of said planar body at approximately the attachment of said outward extension to said body, having a lip formed thereon adapted to engage the underside of the annular flange on the jar lid, whereby lifting the first end of the body will help break the seal and enable removal of the jar lid from the jar.

13. The multi-purpose closure opener as described in claim 12 wherein said ribs are evenly spaced on said first engagement area and on said second engagement area and said evenly spaced ribs of said first cap engagement area are of an axial extent which is less than the axial extent of said evenly spaced ribs of said second cap engagement area.

14. The multi-purpose closure opener as described in claim 12 wherein said body has a magnet affixed to the top surface for enabling mounting of the opener on a metallic surface.

* * * * *